US010088268B2

(12) United States Patent
Hewes et al.

(10) Patent No.: US 10,088,268 B2
(45) Date of Patent: Oct. 2, 2018

(54) ADJUSTABLE LENGTH STOCK ASSEMBLY AND BUFFER CATCH FOR A FIREARM

(71) Applicant: Troy Industries, Inc., West Springfield, MA (US)

(72) Inventors: David A. Hewes, Chesterfield, MA (US); Thomas A. Gray, Westfield, MA (US); Stephen P. Troy, Jr., West Springfield, MA (US)

(73) Assignee: TROY INDUSTRIES, INC., West Springfield, MA (US)

( * ) Notice: Subject to any disclaimer, the term of this patent is extended or adjusted under 35 U.S.C. 154(b) by 0 days.

(21) Appl. No.: 15/592,131

(22) Filed: May 10, 2017

(65) Prior Publication Data

US 2017/0328672 A1 Nov. 16, 2017

Related U.S. Application Data

(60) Provisional application No. 62/333,999, filed on May 10, 2016.

(51) Int. Cl.

| | |
|---|---|
| ***F41A 3/84*** | (2006.01) |
| ***F41C 23/14*** | (2006.01) |
| ***F41A 3/66*** | (2006.01) |

(52) U.S. Cl.

CPC ..... *F41C 23/14* (2013.01); *F41A 3/66* (2013.01); *F41A 3/84* (2013.01)

(58) Field of Classification Search

CPC .... F41C 23/14; F41A 3/84; F41A 3/78; F41A 3/80

USPC ..... 42/71.01, 72, 73, 1.06; 89/198

See application file for complete search history.

(56) References Cited

U.S. PATENT DOCUMENTS

| | | | | |
|---|---|---|---|---|
| 2,900,877 | A * | 8/1959 | McClenahan | F41A 3/46 42/16 |
| 9,541,347 | B2 * | 1/2017 | Maugham | F41C 23/04 |
| 9,574,846 | B2 * | 2/2017 | Huang | F41A 3/66 |
| 2017/0205190 | A1 * | 7/2017 | Jen | F41C 23/14 |

* cited by examiner

*Primary Examiner* — Reginald S Tillman, Jr.

(74) *Attorney, Agent, or Firm* — Grossman, Tucker, Perreault & Pfleger, PLLC

(57) ABSTRACT

A stock assembly for a firearm, the stock assembly comprising a buffer catch comprising a movable buffer catch body; a receiver extension comprising a buffer tube; the buffer tube comprising a buffer tube body and a tubular passage within the buffer tube body; the buffer tube body comprising a buffer catch receptacle extending through a wall of the buffer tube body extending along a longitudinal axis of the buffer tube; the buffer catch receptacle configured to receive the buffer catch body therein; the buffer catch body configured to move within the buffer catch receptacle from a home position to a depressed position; and, in the depressed position, the buffer catch body blocks at least a portion of the tubular passage of the buffer tube.

16 Claims, 10 Drawing Sheets

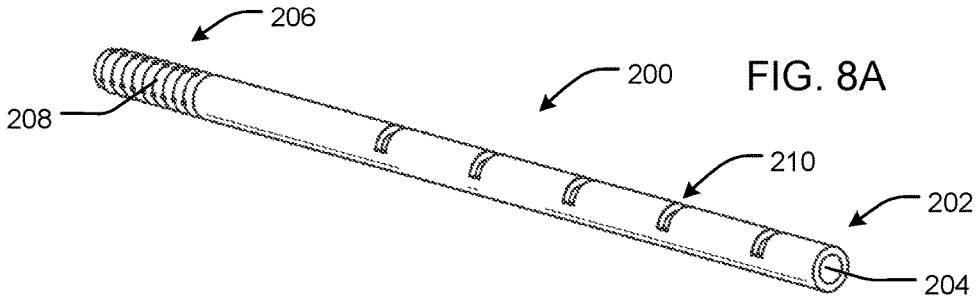
FIG. 8A
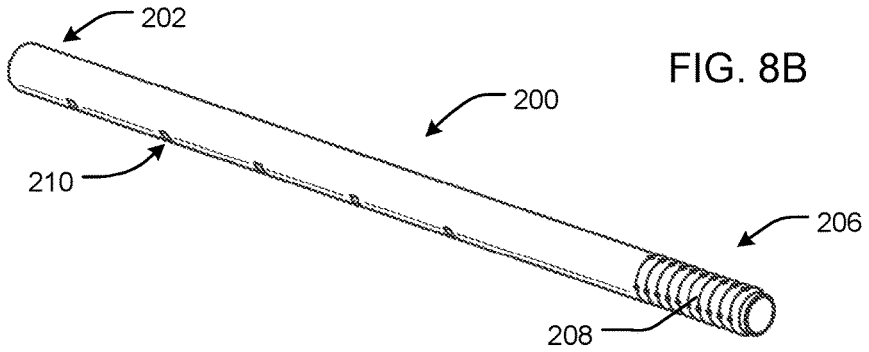
FIG. 8B
FIG. 9A
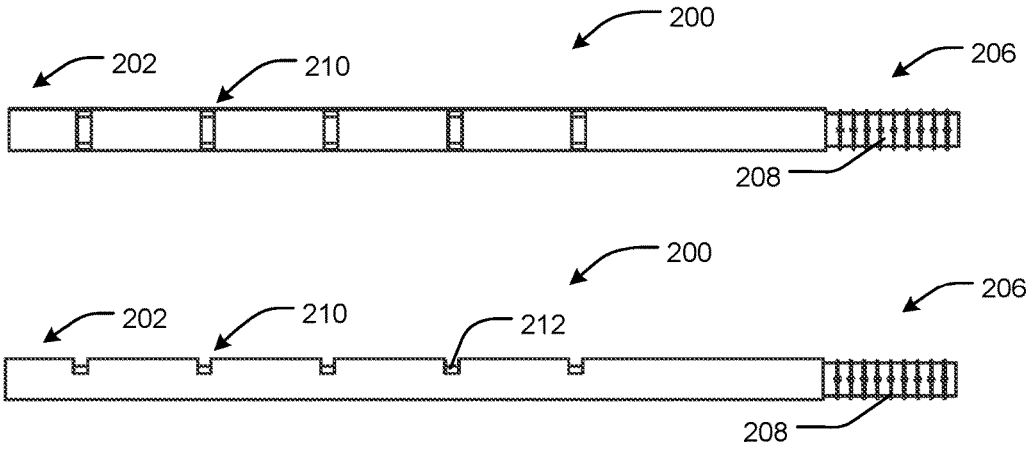
FIG. 9B

ADJUSTABLE LENGTH STOCK ASSEMBLY AND BUFFER CATCH FOR A FIREARM

CROSS-REFERENCE TO RELATED APPLICATIONS

This application claims the benefit of U.S. provisional application No. 62/333,999 filed May 10, 2016, which is hereby incorporated by reference.

FIELD

The present disclosure relates to firearms, and more particularly, to an adjustable length stock assembly suitable for use on certain modular small firearms.

BACKGROUND

Modular small arms, especially rifles, such as the M16 and its civilian variant the AR-15, have been incredibly popular with militaries, law enforcement organizations and civilians alike. Their popularity is due, in large part, to their ability to be seemingly endlessly customized, allowing them to serve in a wide variety of roles. This versatility allows cost savings, through reductions in the purchase of specialized firearms, and inspires operator confidence through familiarity with the platform.

One of the common customizations to such firearms is the replacement of the factory stock. In cases where such a rifle is sold with a fixed stock, it may be replaced with an adjustable one, allowing the user, during use, to adjust the overall length of the rifle to suit different situations that may be encountered. For example, in military use a room clearing situation may be encountered during the same mission as a medium-range (~200-400 yards) target engagement. The room clearing situation may dictate as short of an overall length as possible to maximize the maneuverability of the rifle in what is likely to be tight quarters while a longer overall length may provide better handling characteristics in the medium-range engagement situation.

Even in cases where the rifle is provided with a factory adjustable stock, another might be added that provides a larger range of adjustment. Those that allow for the shortest possible overall length when fully collapsed while maintaining similar or greater overall length to factory-provided solutions when fully extended are especially useful in increasing the versatility of the rifle.

While modular small arms are designed to accommodate a wide range of components, it is sometimes necessary to alter the factory design of various elements in addition to the component being replaced to provide the best performance possible. One instance where this is the case is when attempting to provide the most compact adjustable stock possible, where the factory design of the receiver extension of most popular modular small arms prevents collapsing of the stock beyond a certain point, at least practically, since the receiver extension would protrude from the stock if allowed to collapse beyond a certain point. Unfortunately, current state of the art solutions that provide such benefits also interfere with field-stripping of the firearm and require replacement of the bolt carrier group, receiver extension and/or buffer with one of a proprietary design.

Such compromises require additional operator training in the new field-stripping techniques and reduce the availability of replacement parts in the field. They may also reduce operator confidence in the firearm itself. Additionally, such compromises can reduce the operator's ability to customize further aspects of the firearm, such as the buffer weight used, since current state of the art designs often utilize a one-piece bolt carrier group and buffer assembly.

Another problem with such compact designs is that they tend to be less resistant to collapse, when at full extension, than standard designs. This is because standard stock designs utilize the receiver extension for positioning, which is drastically shortened in ultra-compact stock designs, while current state of the art ultra-compact stock designs use guide rods, which are mounted on either side of the modified receiver extension to support the stock and enable length-adjustments. These guide rods typically have straight cuts in a top portion at substantially equal distances along their length. These cuts engage a retractable protrusion in the stock assembly to lock the stock to a given position on the guide rods. Such a system can allow the stock to collapse under hard use, such as during fully-automatic fire, since the contact area between the protrusion and guide rod cuts is limited by the depth of cut that may be made without unduly weakening the guide rods.

What is needed, therefore, is a compact and robust stock for modular small arms that allows for routine maintenance procedures to be carried out without substantial additional training.

SUMMARY

In at least one embodiment of the present disclosure, a stock assembly for a firearm is provided, with the stock assembly comprising a buffer catch comprising a movable buffer catch body; a receiver extension comprising a buffer tube; the buffer tube comprising a buffer tube body and a tubular passage within the buffer tube body; the buffer tube body comprising a buffer catch receptacle extending through a wall of the buffer tube body extending along a longitudinal axis of the buffer tube; the buffer catch receptacle configured to receive the buffer catch body therein; the buffer catch body configured to move within the buffer catch receptacle from a home position to a depressed position; and in the depressed position, the buffer catch body blocks at least a portion of the tubular passage (64) of the buffer tube.

In at least one embodiment of the present disclosure, a buffer is configured to move within the tubular passage of the buffer tube; and the buffer comprises a front section configured to reside within a bolt carrier of the firearm.

In at least one embodiment of the present disclosure, a buffer is configured to move within the tubular passage of the buffer tube; and the buffer comprises a front section, an intermediate section and a rear section; the front section having a front section diameter; the intermediate section having an intermediate section diameter; the rear section having a rear section diameter; the intermediate section diameter larger than the rear section diameter; and the rear section diameter larger than the front section diameter.

In at least one embodiment of the present disclosure, a buffer is configured to move within the tubular passage of the buffer tube; the buffer comprises a front section, an intermediate section and a rear section; and the intermediate section providing an annular shoulder having a front face and a rear face.

In at least one embodiment of the present disclosure, the front face of the annular shoulder of the buffer has an annular recess; the buffer catch body has a rear face configured to engage with the front face of the annular shoulder (83) of the buffer; the rear face of the buffer catch body has a protrusion; and, in the depressed position, the annular recess of the buffer is configured to receive the protrusion of the buffer catch body.

In at least one embodiment of the present disclosure, the buffer catch body is configured to move inward within the buffer catch receptacle from the home position to the depressed position, and vice-versa.

In at least one embodiment of the present disclosure, a biasing member is configured to bias depressing the buffer catch body from the home position to the depressed position.

In at least one embodiment of the present disclosure, a retaining member is configured to retain the buffer catch body in the buffer catch receptacle.

In at least one embodiment of the present disclosure, the stock assembly (50) is configured to be installed on an M/16 AR-15 pattern firearm.

In at least one embodiment of the present disclosure, a stock assembly for a firearm, with the stock assembly comprising a first guide rod and a second guide rod, each of the first guide rod and the second guide rod including a plurality of length adjustment recesses disposed in spaced relationship along a length of the guide rod; a guide rod latch comprising a movable guide rod latch body having first guide rod tubular passage and a second guide rod tubular passage; a receiver extension comprising a buffer tube, a first guide rod support and a second guide rod support, the buffer tube, the first guide rod support and the second guide rod support each extending along a longitudinal axis of the receiver extension; the first guide rod support and the second guide rod support disposed lateral of a longitudinal length of the buffer tube; each of the first guide rod support and second guide rod support comprising a front guide rod support and a rear guide rod support, the front guide rod support and the rear guide rod support each longitudinally spaced from one another along the longitudinal axis of the receiver extension; the guide rod latch body disposed between the front guide rod support and a rear guide rod support of each of the first guide rod support and the second guide rod support; the front guide rod support and a rear guide rod support of each of the first guide rod support and the second guide rod support each including a tubular passage; the first guide rod extending through the tubular passage of the front guide rod support and a rear guide rod support of the first guide rod support and the first guide rod tubular passage of the guide rod latch body; the second guide rod extending through the tubular passage of the front guide rod support and a rear guide rod support of the second guide rod support and the second guide rod tubular passage of the guide rod latch body; the guide rod latch body configured to move from a home position to a depressed position; in the home position, the guide rod latch body occupies one of the length adjustment recesses of the plurality of length adjustment recesses of each of the first guide rod and the second guide rod; and, in the depressed position, the guide rod latch body is removed from occupying the length adjustment recesses of the plurality of length adjustment recesses of each of the first guide rod and the second guide rod.

In at least one embodiment of the present disclosure, the first guide rod tubular passage and the second guide rod tubular passage of the guide rod latch body each include a protrusion; and, in the home position, each of the protrusions of guide rod latch body occupies one of the length adjustment recesses of the plurality of length adjustment recesses of each of the first guide rod and the second guide rod.

In at least one embodiment of the present disclosure, the protrusion of each of the first guide rod tubular passage and the second guide rod tubular passage of the guide rod latch body is a rib.

In at least one embodiment of the present disclosure, the rib protrusion of each of the first guide rod tubular passage and the second guide rod tubular passage of the guide rod latch body has an arcuate leading edge and/or leading surface.

In at least one embodiment of the present disclosure the plurality of length adjustment recesses disposed in spaced relationship along the length of each guide rod are each formed as an arcuate notch.

In at least one embodiment of the present disclosure, the plurality of arcuate notches disposed in spaced relationship along the length of each guide rod each have an arcuate bottom.

In at least one embodiment of the present disclosure, a biasing member is configured to bias depressing the guide rod latch body from the home position to the depressed position.

In at least one embodiment of the present disclosure, a stock is provided; and the first guide rod and the second guide rod are each attached to the stock.

In at least one embodiment of the present disclosure, the receiver extension comprises the buffer tube, the first guide rod support and the second guide rod support formed as a one-piece structure.

In at least one embodiment of the present disclosure, the stock assembly is configured to be installed on an M/16 AR-15 pattern firearm.

FIGURES

The above-mentioned and other features of this disclosure, and the manner of attaining them, will become more apparent and better understood by reference to the following description of embodiments described herein taken in conjunction with the accompanying drawings, wherein:

FIGS. 8A and 8B are front and rear perspective views, respectively, of a guide rod of the collapsible/extendable stock assembly of the firearm of FIGS. 1A-1D;

FIG. 9A is a top view of the guide rod of the collapsible/extendable stock assembly of the firearm of FIGS. 1A-1D;

FIG. 9B is a side view of the guide rod of the collapsible/extendable stock assembly of the firearm of FIGS. 1A-1D;

DETAILED DESCRIPTION

Figure 1A:
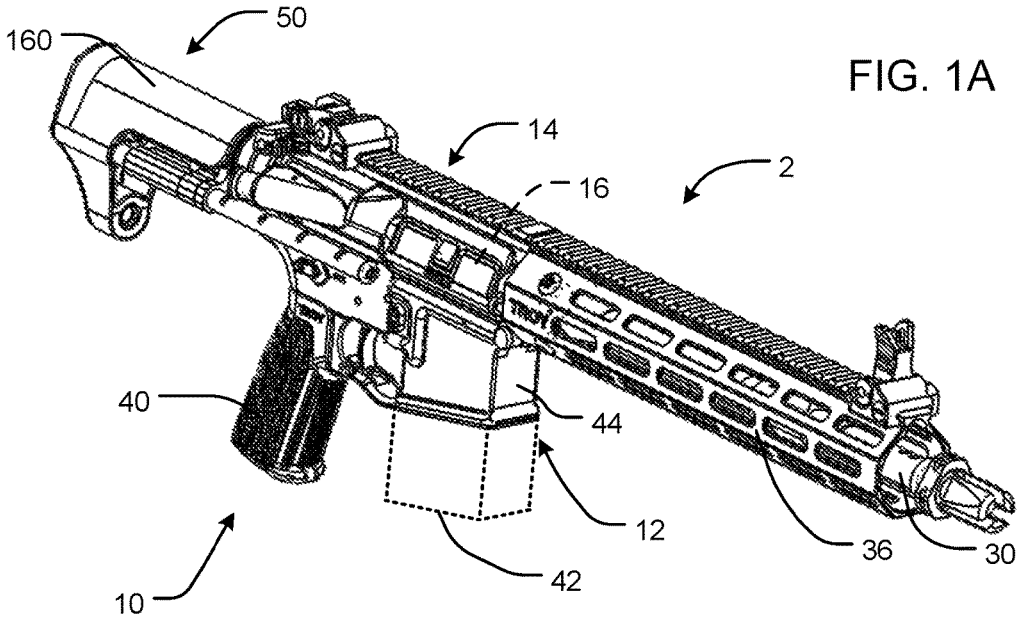
FIG. 1A is a front upper perspective view of a firearm with a collapsible/extendable stock assembly according to an embodiment of the present disclosure.
Figure 1B:
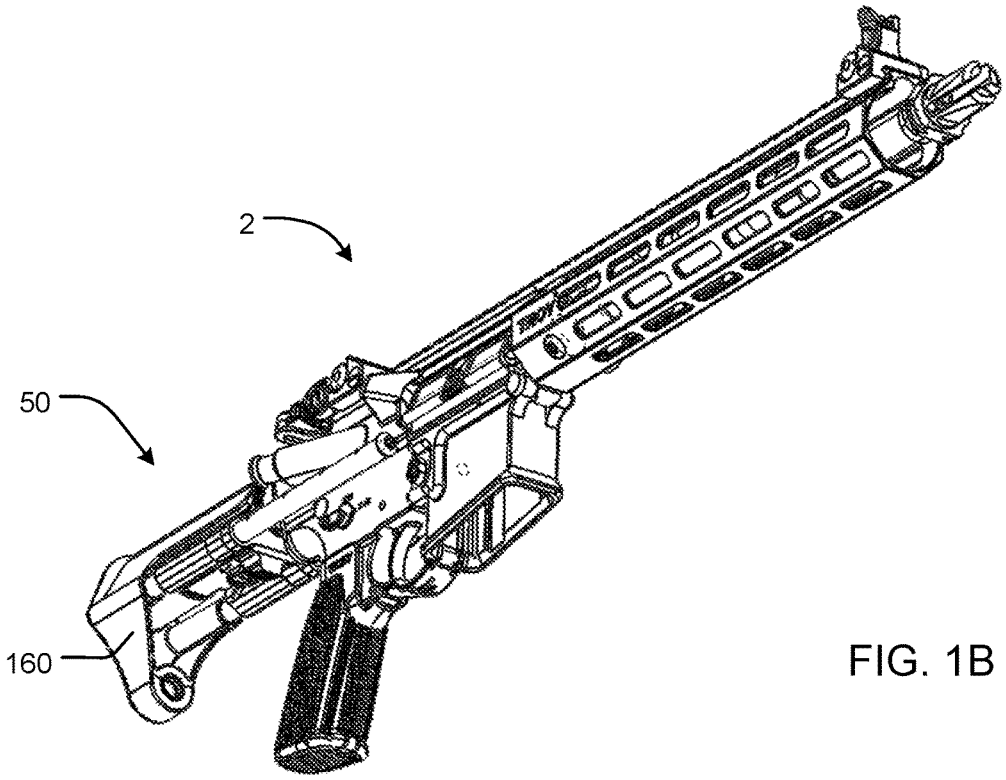
FIG. 1B is a front lower perspective view of the firearm of FIG. 1A.
Figure 1C:
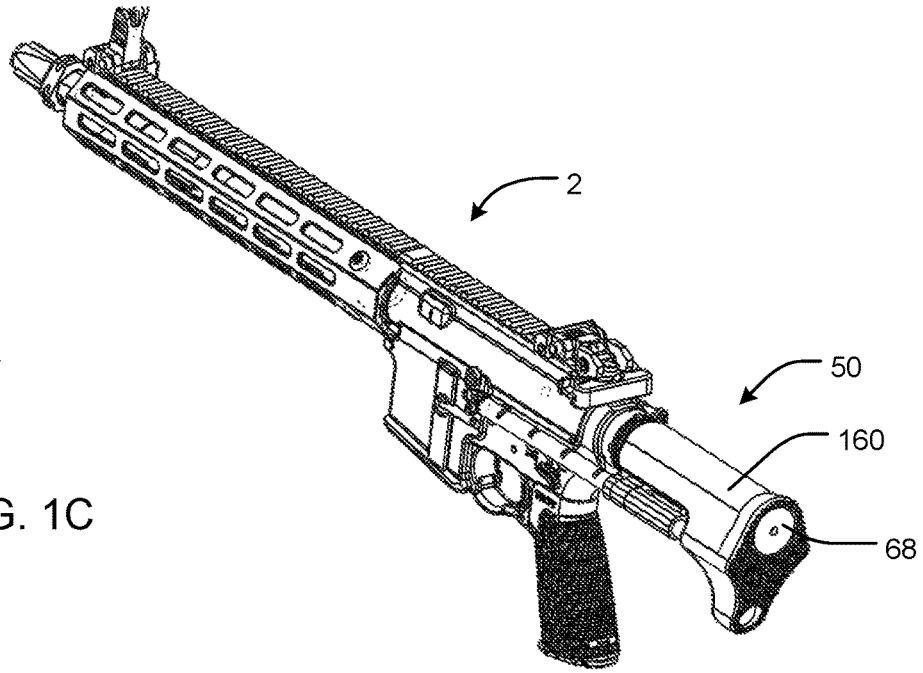
FIG. 1C is a rear upper perspective view of the firearm of FIG. 1A.
Figure 1D:
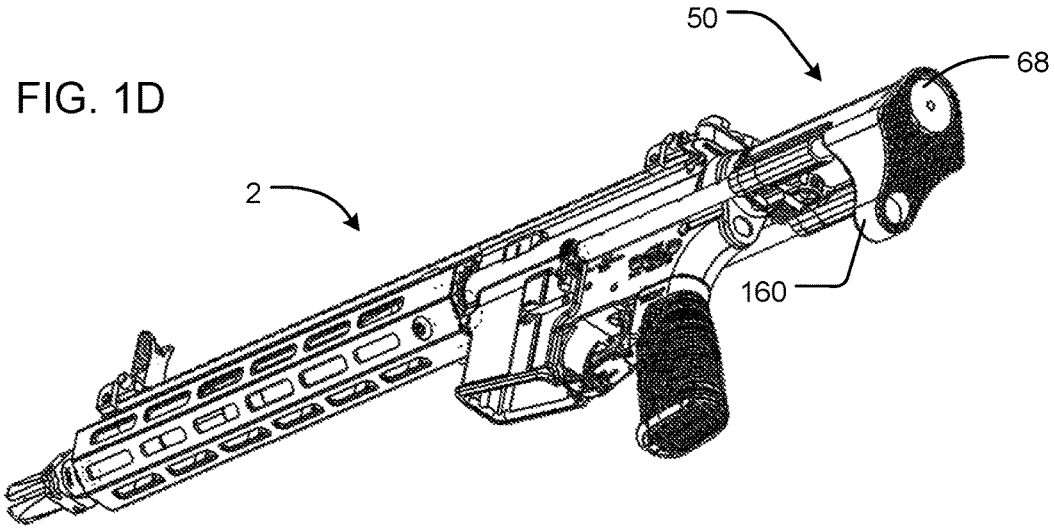
FIG. 1D is a rear lower perspective view of the firearm of FIG. 1A.

It may be appreciated that the present disclosure is not limited in its application to the details of construction and the arrangement of components set forth in the following description or illustrated in the drawings. The invention(s) herein may be capable of other embodiments and of being practiced or being carried out in various ways. Also, it may be appreciated that the phraseology and terminology used herein is for the purpose of description and should not be regarded as limiting as such may be understood by one of skill in the art.

Referring now to FIGS. 1A-1D, there is shown a firearm 2 including an adjustable length stock assembly 50 according to the present disclosure. As shown, firearm 2 comprises a receiver 10, which comprises a lower receiver 12 and a mating upper receiver 14. Upper receiver 14 includes bolt carrier group 16, including a bolt carrier, bolt and firing pin, as well as charging handle, sights and gas system. A barrel 30, surrounded by a handguard 36, is affixed to the front end of upper receiver 14 and the adjustable length stock assembly 50 is affixed to the rear end of lower receiver 12.

A trigger portion of upper receiver 14 fits into an access opening in lower receiver 12 and is integrated with the internal mechanism of upper receiver 14 and lower receiver 12. Lower receiver 12 includes a pistol grip, as well as the fire control group. A detachable (removable) box magazine 42 as known in the art (shown in phantom) may be inserted into a magazine receptacle 44 having a downwardly oriented access opening in lower receiver 12 for feeding cartridges to the cartridge insertion and ejection mechanism within upper receiver 14. The detachable magazine 42 is capable of being loaded and unloaded while detached from firearm 2, and holds the cartridges side-by-side in one or more columns/rows, which may be staggered. In certain embodiments, the detachable magazine 42 may also comprise a drum magazine in which the cartridges are positioned and fed in an unwinding spiral.

As shown, firearm 2 comprises a gas-operated semi-automatic or automatic firearm, and more particularly a direct gas impingement gas-operated semi-automatic or fully-automatic firearm. As explained in greater detail below, with a direct gas impingement gas-operated firearm, the direct gas impingement system may be understood to direct hot propellant combustion gas from a fired cartridge directly to the bolt carrier group 16 of the receiver 10 to cycle the action of the firearm 2.

More particularly, as shown, firearm 2 is an M16/AR-15 pattern firearm, which may include the M16, M16A1, M16A2, M16A3, M16A4, M4, M4A1, AR-10, AR-15 and CAR-15. Furthermore, firearm 2 may be categorized as a rifle, a carbine, a mid-length or a pistol, particularly depending on barrel length. As shown, firearm 2 is an M16/AR-15 rifle.

Figure 2:
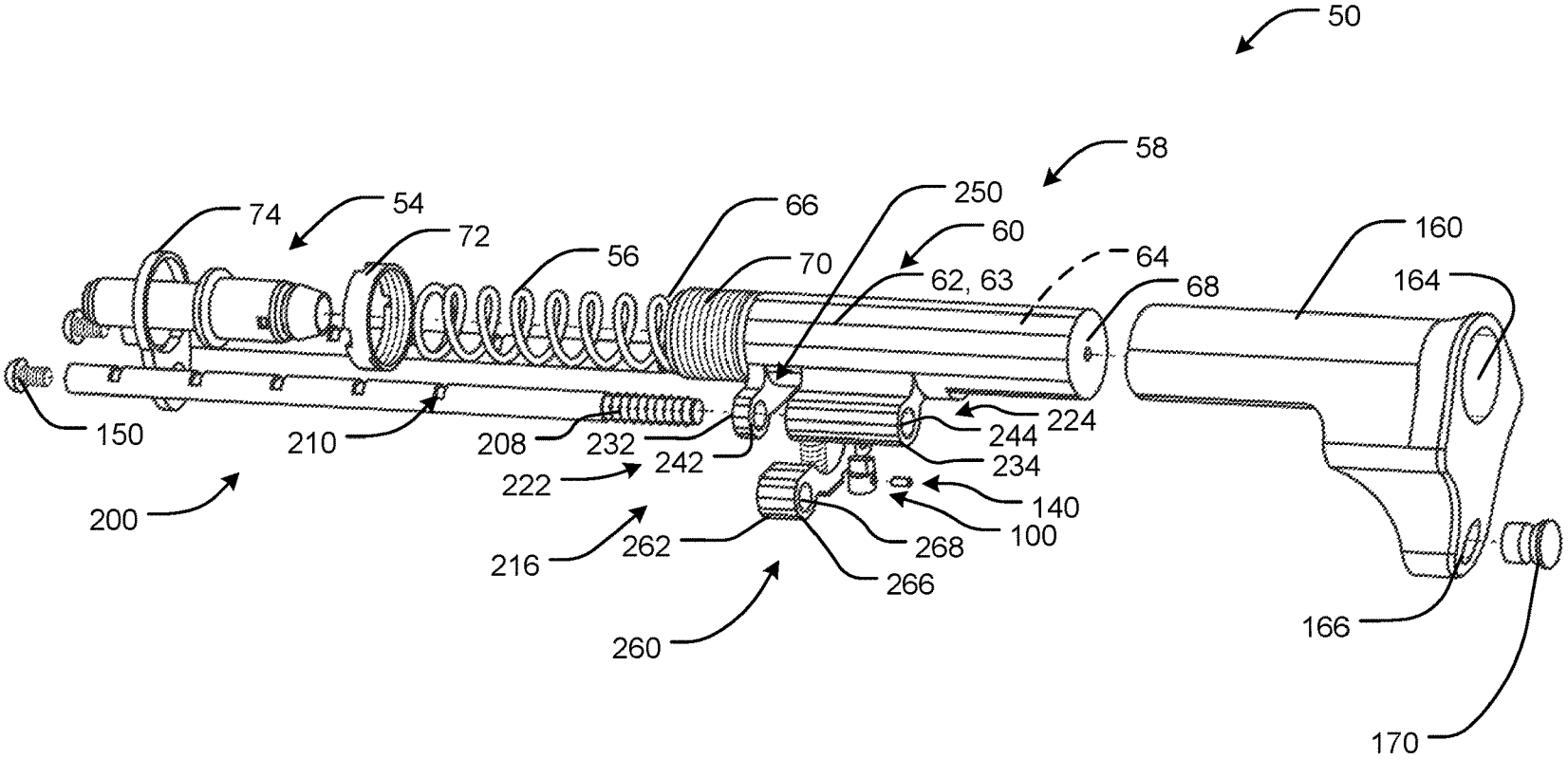
FIG. 2 is an exploded side perspective view of the collapsible/extendable stock assembly of the firearm of FIGS. 1A-1D.

Referring now to FIG. 2, there is shown an exploded view of the adjustable length stock assembly 50 of FIGS. 1A-1D. As shown, the components of the stock assembly 50 include a buffer 54, a recoil (helical compression) spring 56 and a receiver extension 58, arranged front to rear along a longitudinal axis of the firearm 2.

As may be understood from FIG. 2, the collapse of the stock 60 is limited by the longitudinal length of the receiver extension 58. The collapse limitation of the stock 60 may be understood to be a result of a fundamental design of the M16/AR-15 platform firearm 2 which, as indicated above, utilizes a direct impingement gas system to cycle the action. Such systems use the gas pressure created during a firing sequence to directly drive the semi-automatic or fully automatic action of the firearm 2.

These designs function off of a combustion gas outlet port that is cut into the barrel 30, which is positioned at a particular distance from the chamber, creating a path between the bore and the exterior of the barrel 30. During operation, the combustion gas outlet port allows a regulated amount of high pressure gas, generated during a firing sequence, to be siphoned from the bore, providing the force used to cycle the action, enabling semi-automatic or fully-automatic fire, dependent on the configuration of the firearm 2. The distance between the chamber and combustion gas outlet port, among other factors, determines the delay between firing of a round and cycling of the action.

A gas block, which is partially hollow, is used to redirect the high-pressure gases, which are generated during a firing sequence, to the action, namely the bolt carrier group 16. The gas block is fastened onto the barrel 30, over the portion containing the combustion gas outlet port. A gas tube is then connected to a rear portion thereof, forming a pathway between the bore and tube and conveying gases generated during a firing sequence to the bolt carrier group 16, which comprises a bolt carrier and bolt. These gases provide the force necessary to move the bolt carrier rearward. This process initiates a camming action between the stationary bolt and sliding bolt carrier, which is prevented from rotating by the design of the upper receiver 14 in which it is mounted, causing the bolt to rotate, allowing it to unlock from the barrel (locking lugs and barrel lugs prevent their separation in an un-rotated state) and move rearwards with the bolt carrier 18.

During operation, the bolt carrier group 16 continues its rearward motion outside of the upper receiver 14 and, partially, into the receiver extension 58 and, more particularly, the buffer tube 60 thereof. This rearward motion is dampened by buffer 54, which is essentially a weight. Rearward motion of the buffer 54 is biased by recoil spring 56 contained within the buffer tube 60 of the receiver extension 58 opposite the bolt carrier group 16, which biases the bolt carrier group 16 forward. Once the motion of the bolt carrier group 16 has been stopped by the buffer 54 and recoil spring 56, it is pushed back into a forward position, stripping and chambering a fresh round in the process, at which point the cycle repeats.

Receiver extension 58 is assembled to lower receiver 12, particularly by threaded engagement. As shown, front end portion 64 of buffer tube (tubular) body 62 of the buffer tube 60 includes external threads, which thread to internally threaded annular (closed ring) mount of the lower receiver 12. Prior to assembly, receiver extension (castle) nut 72 is treaded onto front end portion 70 and thereafter receiver end plate 74 is arranged on the front end portion 70. Thereafter, the front end portion 70 of buffer tube (tubular) body 62 is threaded onto the internally threaded annular mount of the lower receiver 12. Once properly threaded, the receiver end plate 74 is secured by threading the receiver extension (castle) nut 72 against the receiver end plate 74. Thereafter, the recoil spring 56 and buffer 54 may be placed in the tubular passage 64 of the buffer tube (tubular) body 62 through tubular passage opening 66 at the front end of the buffer tube (tubular) 62 while being contained therein by rear end wall 68 at the rear end of the buffer tube (tubular) body 62.

As compared to factory/standard military grade M16/AR-15 firearm, which makes use of a receiver extension 58/buffer tube 60 having a longitudinal length of about six (6) inches, the receiver extension 58/buffer tube 60 of stock assembly 50 of the present disclosure has a longitudinal length of about four and one-half (4.5) inches.

Figure 3:
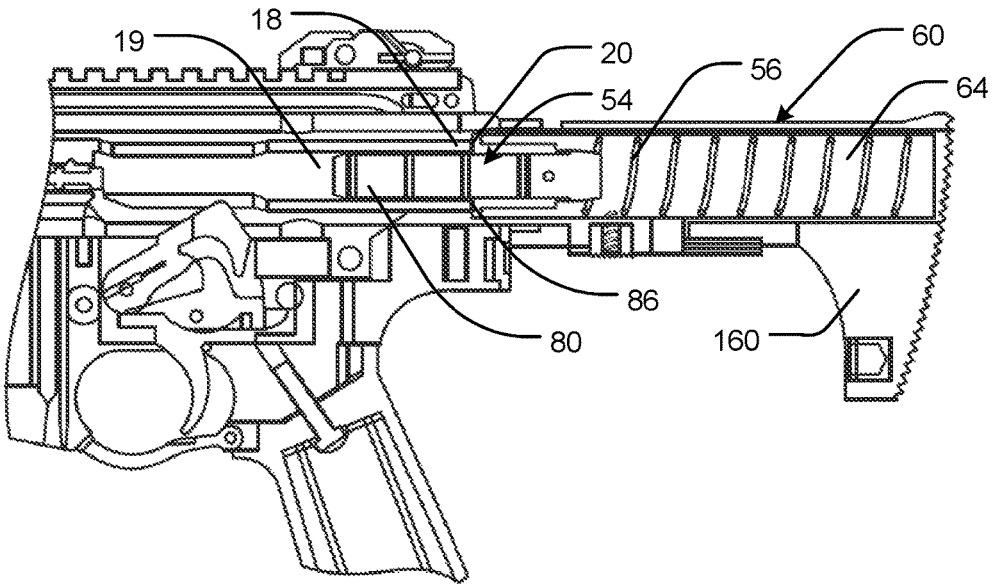
FIG. 3 is a left side sectional view of the receiver and collapsible/extendable stock assembly of the firearm of FIGS. 1A-1D, with the stock assembly collapsed and the firearm in a ready-to-fire state.

Referring to FIG. 3, to make use of the shortened buffer tube 60 length of the receiver extension 58 of the present disclosure, the stock assembly 50 further makes use of a buffer 54 comprising a front section 80 having an outer size (which may also be referred to as the outer periphery or perimeter), shown as an outer diameter, suitable for insertion into and residing in the rear portion (inner diameter) of a tubular passage (bore) 19 of a factory/standard M16/AR-15 bolt carrier 18. As such, the stroke of the buffer 54 is now partly performed within the confines of the bolt carrier 18, thus enabling corresponding shortening of the buffer tube 60 by the length of the stroke now accommodated in the bolt carrier 16. In contrast, with a factory/standard M16/AR-15 firearm, which makes use of a receiver extension 58/buffer tube 60 having a longitudinal length of about six inches, the buffer does not enter the bolt carrier, but rather impacts the rear end 20 of the bolt carrier 18.

Figure 4:
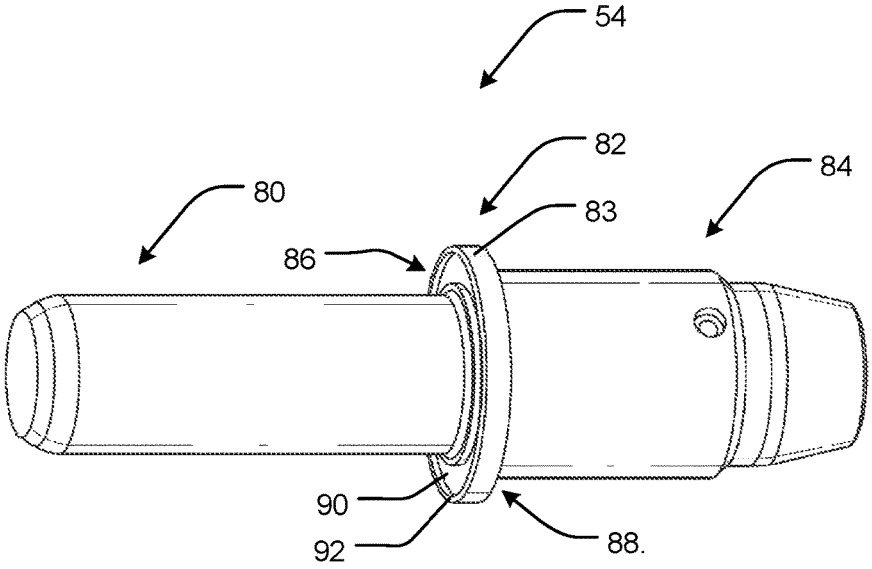
FIG. 4 is a side view of a buffer of the collapsible/extendable stock assembly of the firearm of FIGS. 1A-1D.

Referring to FIG. 4, in addition to front section 80, buffer 54 further includes an intermediate section 82 and a rear section 84. As shown, the intermediate section 82 has the largest outer diameter, followed by rear section 84 which has a larger outer diameter than the outer diameter of front section 82.

As explained above, front section 80 of buffer 54 has an outer diameter suitable for insertion into the inner diameter of a factory/standard M16/AR-15 bolt carrier 18, particularly with the outer diameter of the front section 80 being sized for sliding engagement within the inner diameter of the tubular passage 19 of the bolt carrier 18. Similarly the rear section 84 of the buffer 54 has a diameter suitably sized for insertion into, and sliding engagement within, the inner diameter of recoil spring 56. Finally, intermediate section 82 is suitably sized for insertion into, and sliding engagement within, tubular passage 62 of the buffer tube (tubular) body 62 of buffer tube 60.

Intermediate section 82 of buffer 54, by virtue of having a larger diameter than front section 80 and rear section 84, is has a shape of a round disk/annular shoulder 83, particularly having a front face 86 and an opposing rear face 88. As may be understood from FIG. 3, front face 86 engages (contacts) with the rear end 20 of bolt carrier 18 during operation of firearm 2, while rear face 88 engages (contacts) with the front end of recoil spring 56 during operation of firearm 2.

Front face 86 of intermediate section 82 includes a recessed portion in the form of an annular recess 90 adjacent the outer diameter. Front face 86 further includes an annular lip 92, which forms part of the outer diameter of the intermediate section 82.

Figure 5:
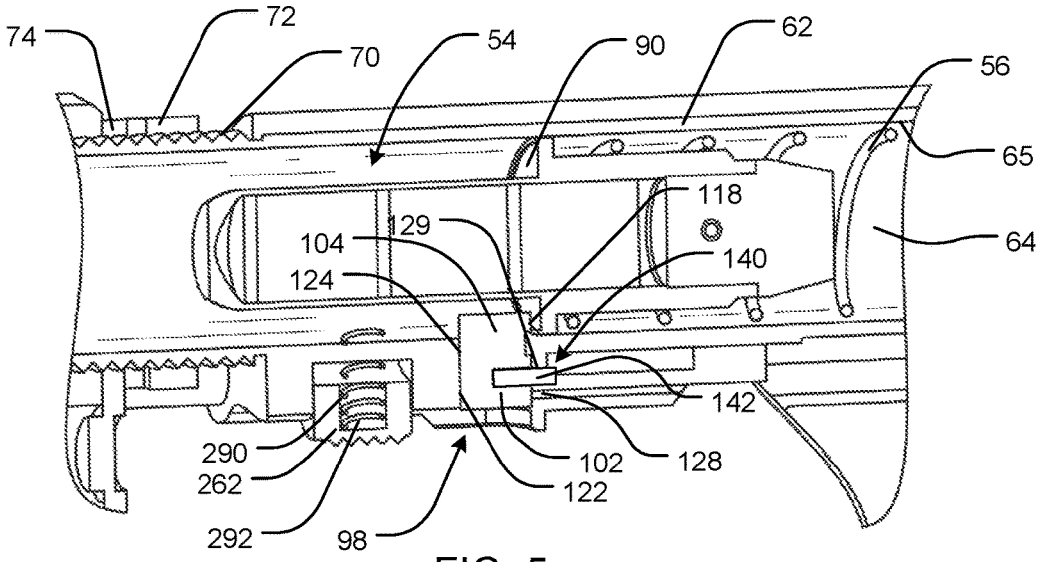
FIG. 5 is a left side sectional view of the collapsible/extendable stock assembly of the firearm of FIGS. 1A-1D, with the stock assembly collapsed in a state suitable for disassembly, wherein the buffer of is held by a buffer catch of a receiver extension of the stock assembly.

As best shown by FIG. 5, the front face 86 of intermediate section 82 is configured to positively mechanically engage with a buffer catch 98. While shown integrated into the lower side (bottom) of the buffer tube (tubular) body 62 of the buffer tube 60, the buffer catch 98 present disclosure is not limited to such location.

Figure 6:
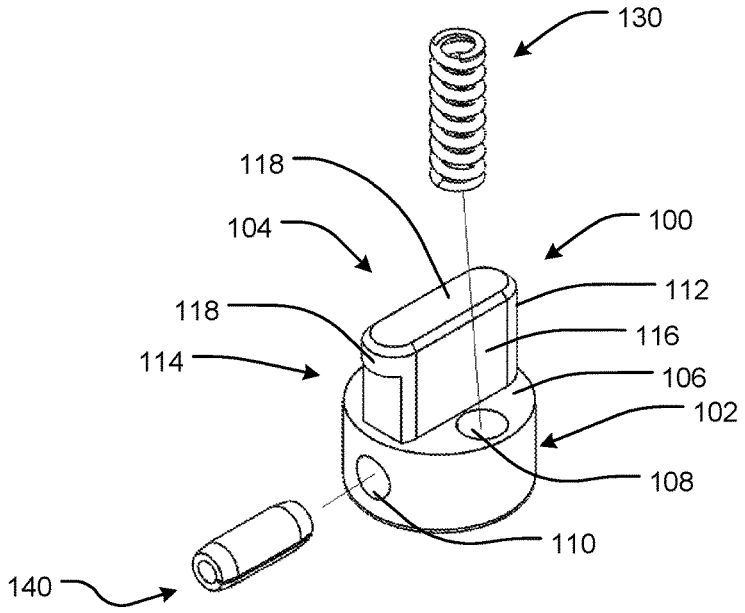
FIG. 6 is a side perspective view of certain components of the buffer catch of the collapsible/extendable stock assembly of the firearm of FIGS. 1A-1D, particularly the buffer catch body, biasing member and retaining member.

Engageabledisengageable buffer catch 98, which also may be referred to as lockable/unlockable, comprises a movable buffer catch body 100, which is configured to move with linear motion transverse to the longitudinal axis of the buffer 54/recoil spring 56/receiver extension 58. As best shown by FIG. 6, buffer catch body has a cylindrical outer section 102 which underlines an oblong inner (buffer engagement) section 104, though the present disclosure is not limited to the particular cylindrical and rectangular shapes shown. In the orientation shown, outer section 102 may also be considered a lower section, while inner section 104 is an upper section.

Figure 7:
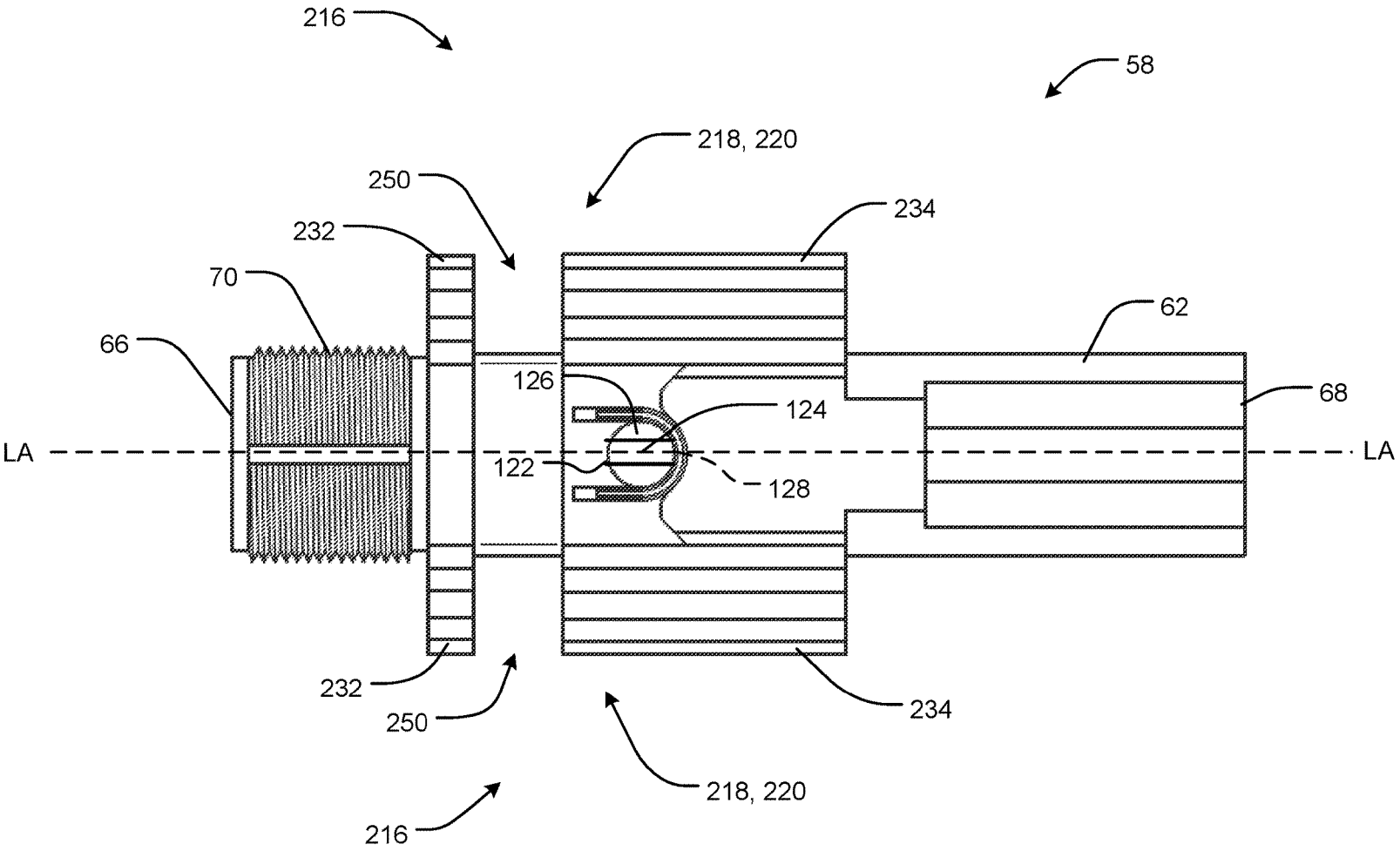
FIG. 7 is a bottom view of the receiver extension of the collapsible/extendable stock assembly of the firearm of FIGS. 1A-1D.

Buffer catch body 100 occupies a buffer catch body receptacle 120 formed in a longitudinally extending (side) wall 63 of the buffer tube (tubular) body 62 of the buffer tube 60. As best shown by FIG. 7, buffer catch body receptacle 120 comprises a cylindrical recess outer section 122 and a rectangular through-hole inner section 124 which are configured to receive cylindrical outer section 102 and rectangular inner section 104 of buffer catch body 100, respectively.

During inward movement of the buffer catch body 100, the shoulder 106 of outer section 102 of buffer catch body 100 may contact the bottom wall 126 of the cylindrical recess outer section 122 of the buffer catch body receptacle 120 to limit inward movement.

In order to bias inward movement of buffer catch body 100, the buffer catch 98 may include a biasing member 130, which may particularly be in the form of a helical compression spring. Biasing member 130 may be inserted into biasing member receptacle 108, which may be particularly in the form of a blind bore formed in the cylindrical outer section 102 of buffer catch body 100. The biasing member 130 is slidable within the biasing member receptacle 108 and, in an uncompressed state, has a length greater than the length of the biasing member receptacle 108. As shown, the opening to the blind bore of the biasing member receptacle 108 of the buffer catch body 100 may be located on shoulder 106 of buffer catch body 100. With such an arrangement, the biasing member 130 may contact against the bottom wall 126 of the cylindrical recess outer section 122 during use thereof, to bias inward movement of the buffer catch body 100.

In order to retain the buffer catch body 100 within the buffer catch receptacle 102, the buffer catch 98 may include a buffer catch body retaining member 140. Retaining member 140, may particularly be in the form of a pin, such as a spring pin or a crush pin. Retaining member 140 may be inserted into retaining member receptacle 110, particularly which may be particularly in the form of a blind bore formed in the cylindrical outer section 102 of buffer catch body 100.

Retaining member 140 may be retained in biasing member receptacle 108 with a press (interference) fit.

The retaining member 140 has a length which is greater than the length of the retaining member receptacle 110 such that an exposed portion 142 of the retaining member 140 protrudes outwardly from the cylindrical outer section 102. Upon assembly, the exposed portion 142 of the retaining member 140 occupies a retaining member travel receptacle 128, which may particularly be in the form of an elongated slot, which limits inward and outward travel of the retaining member as the retaining member contacts travel receptacle stops 129 formed by the receiver extension at opposing ends of the retaining member travel receptacle 128.

Oblong inner section 104 has a front face 112 and a rear face 114 separated longitudinally by two planar longitudinal side (lateral) faces 116, which extend along the longitudinal axis of the buffer 54/recoil spring 56/receiver extension 58. Front face 112 has a constant curved surface along the complete height of the oblong inner section 104. The curved surface is curved about an axis transverse to the longitudinal axis of the buffer 54/recoil spring 56/receiver extension 58.

Similar to front face 112, rear face 114 includes a constant curved surface along the height of the oblong inner section 104, however the curved surface is only present along a portion of the height of the oblong inner section 104, particularly the inner most portion of the height of the oblong inner section 104. Rear face further includes a surface portion which is planar about an axis transverse to the longitudinal axis of the buffer 54/recoil spring 56/receiver extension 58.

As shown, when the curved surface portion and planar surface portions of rear face 114 are arranged relative to one another as to form an L-shaped protrusion 118. As best shown by FIG. 5, when the buffer catch body 100 is depressed inward and engaged with buffer 54, projection 118 on the rear face 114 of the buffer catch body 100 is configured to be received into the annular recess 90 on the front face 86 of the intermediate section 82 of the buffer 54. In such manner, the buffer catch body 100 is configured to block/occlude at least a portion of the tubular passage 64 and capture the buffer 54 in a rearward portion of the tubular passage 64 of the buffer tube 50, as well as inhibit forward motion of the buffer 54 from the rearward position in the buffer tube 50.

Alternatively, in a home/rest position, which may also be referred to as a release position or disengaged position, the inner face 118 of the inner section 104 of the buffer catch body 100 of the buffer catch 98 is substantially flush with the inner face 65 of the tubular passage 64 of the buffer tube 60. When depressed away from the home position to a depressed position, which also may be referred to as an engaged position, the buffer catch body 100 of the buffer catch 98 protrudes into the tubular passage 64 of the buffer tube 60 and positively mechanically interferes with the return of the buffer 54 to its release position, capturing the buffer 54 within the tubular passage 65 of the buffer tube 60 of the receiver extension 58.

The protrusion 118 functions by interfacing, particularly engaging, with the annular recess 90 of the intermediate section 82 of the buffer 54 to securely hold the buffer 54 back, since it is under substantial spring pressure from the recoil spring 56.

As explained above, the buffer catch 98 of the present disclosure is biased downwards via biasing member 130, so as not to interfere with normal cyclic operation of the firearm 2. Although it is imperative that the buffer catch 98 be biased downwards in some fashion to avoid interfering with the internal reciprocating assemblies of the firearm 2, the use of a coil spring, as shown in the figures, is not considered to be limiting of the disclosure. Other means of biasing the buffer catch 98 away from engagement with the buffer 64, as would be known to those of ordinary skill in the art, should be considered within the scope of this disclosure.

The procedure for field stripping of the firearm 2 configured in accordance with the present disclosure is relatively simple, although slightly different from the procedure associated with a factory/standard M16/AR-15 firearm. When field stripping is required, the operator would be required to pull the bolt rearward, via the charging handle, then push inward (upwards from the bottom) on the buffer catch body 100, which is accessible from bottom the stock, as shown in FIGS. 3 and 5, and release pressure on the charging handle. This results in the buffer 54 being captured within the tubular passage 64 of the buffer tube 60 of the receiver extension 58, prior to the parting line between the lower receiver 12 and the upper receiver 14. The bolt can then be pushed forward via a forward assist that is typically a factory feature of such firearms or manually through a side port, such as that typically covered by a dust cover on a factory/standard M16/AR-15 firearm. After these steps are taken, normal field stripping procedures may be followed.

Referring now to FIGS. 8A-8B, as well as FIGS. 9A-9B, in order to adjust the length of the stock assembly 50, the stock assembly 50 of the present disclosure employs a pair of guide rods 200 which move longitudinally, i.e. along a longitudinal axis LA of the buffer 54/recoil spring 56/receiver extension 58*a*, and more particularly the buffer tube 60. As shown, a front end portion 202 of the guide rod 200 has an internally threaded blind bore 204, while rear end portion 206 includes external threads 208. Internally threaded blind bore 204 threadedly engages with external threads of front end stop 150, which comprises a male threaded fastener such as a screw (see FIG. 2).

Figure 10:
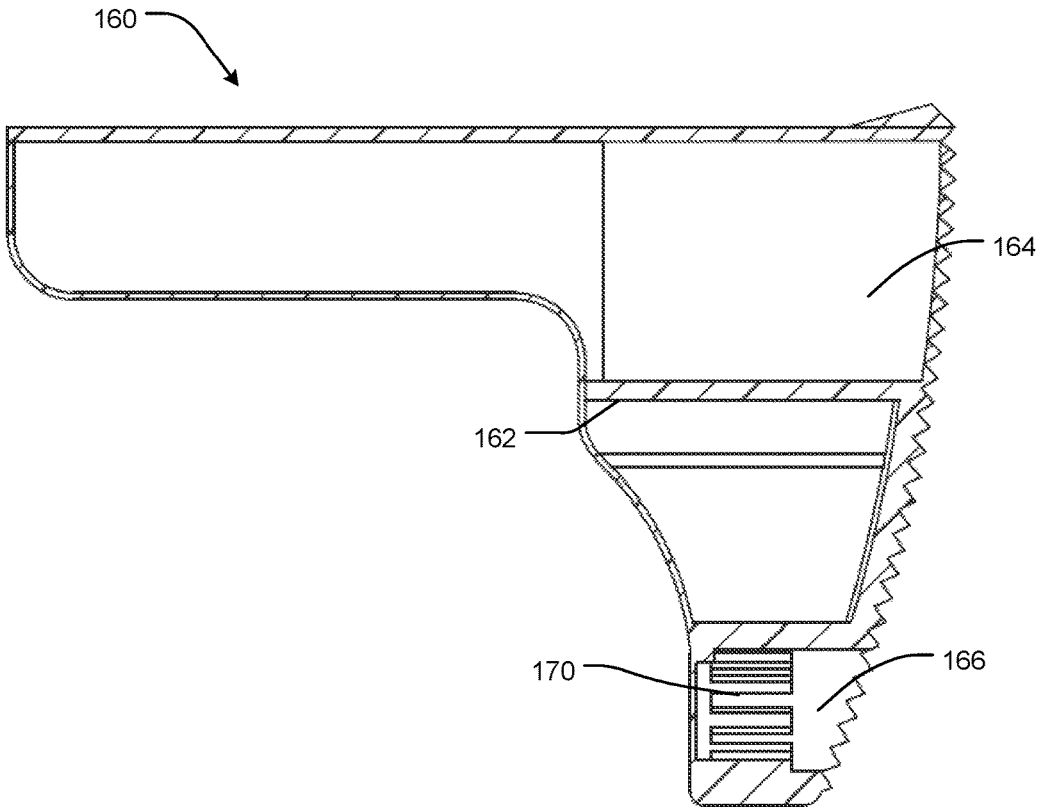
FIG. 10 is a left side sectional view of a stock of the collapsible/extendable stock assembly of the firearm of FIGS. 1A-1D.
Figure 11:
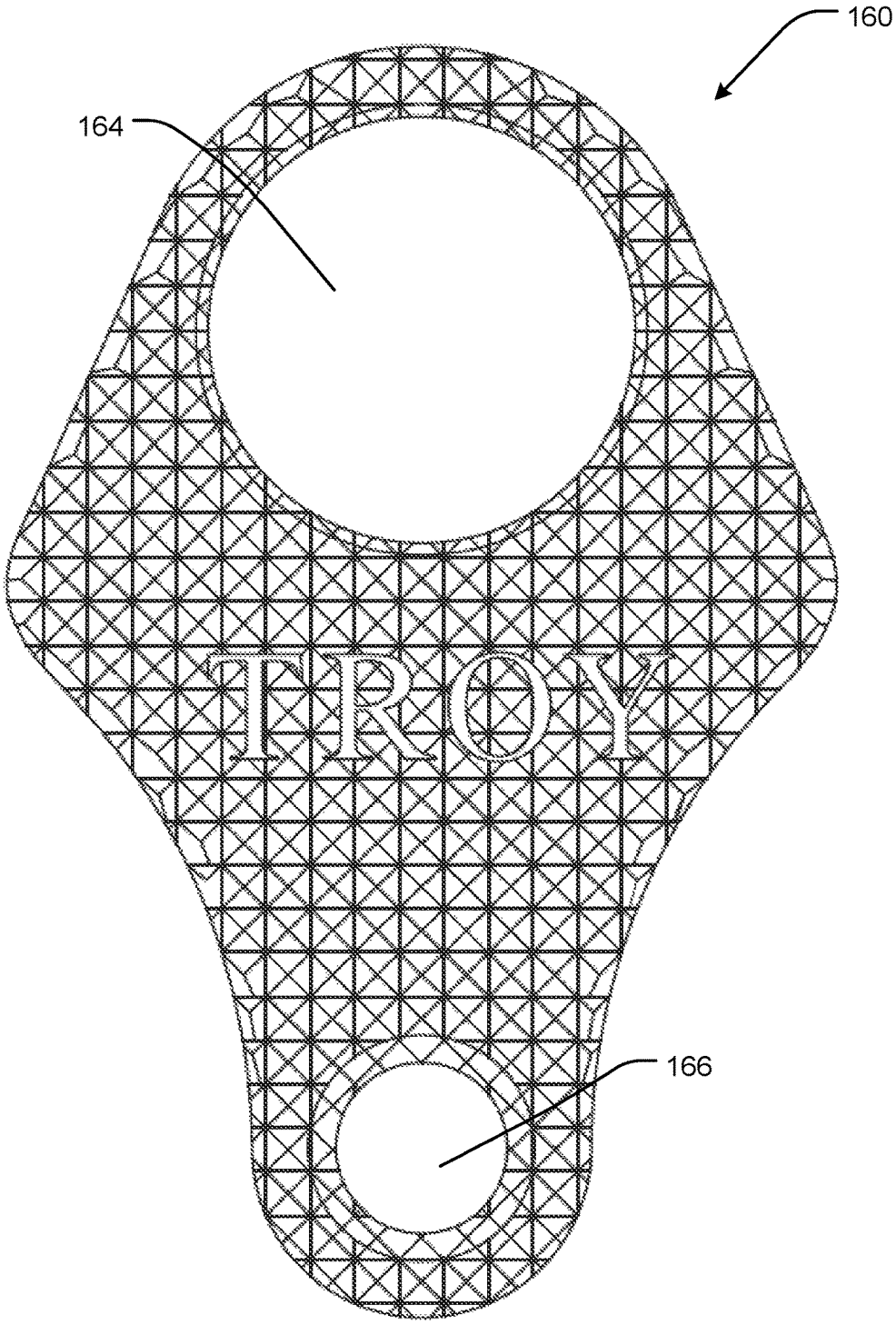
FIG. 11 is a rear view of the stock of the collapsible/extendable stock assembly of the firearm of FIGS. 1A-1D.
Figure 12:
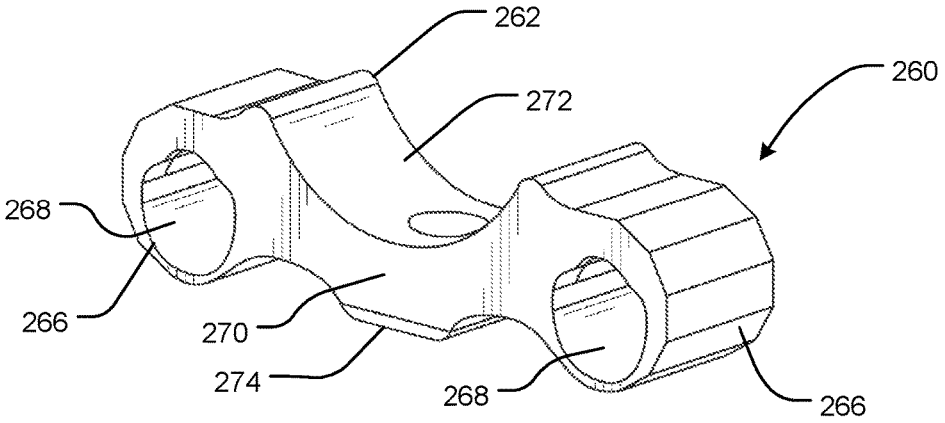
FIG. 12 is a rear perspective view of a stock adjustment lock of the collapsible/extendable stock assembly of the firearm of FIGS. 1A-1D.
Figure 13:
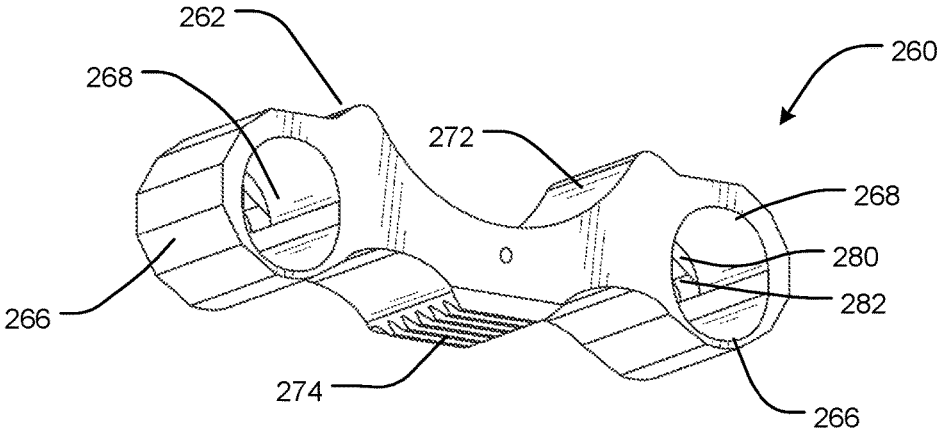
FIG. 13 is a front perspective view of the stock adjustment lock of the collapsible/extendable stock assembly of the firearm of FIGS. 1A-1D.

As shown by FIG. 10, the external threads 208 of guide rod threadedly engage with internal threads of bore of mounting boss 162 of a shoulder stock 160. Also as shown in FIG. 10, as well as FIG. 11, stock 160 includes a buffer tube aperture 164 through which the buffer tube 60 may extend, as well as a sling mount aperture for a sling mount Additionally, each guide rod 200 includes a plurality of equally spaced length adjustment recesses 210, with each recess 210 in the form of arcuate notch (which are shown to be semi-circular around the longitudinal axis LA) with an arcuate bottom surface 212 (which is also shown to be semi-circular around the longitudinal axis LA).

The arcuate notches may be formed by cutting at a constant radius around the longitudinal axis of the guide rod 200, which may be referred to a radial cut. The use of a radial cut may by understood to allow for greater contact area between the guide rod recesses 210 and the protrusions 280 of the guide rod latch 260 discussed below.

As best shown in FIG. 2, each of the guide rods 200 is located (slides) within a guide rod support 216 having a tubular body 218 and tubular passage 220, respectively. As shown, each guide rod support 216 comprises a front guide rod support 222 and a rear guide rod support 224. Front guide rod support 222 and rear guide rod support 224 each comprise a tubular body 232, 234, respectively, which extends longitudinally along a longitudinal length of the receiver extension 58. Front guide rod support 222 and rear guide rod support 224 also each comprise a tubular passage 242, 244, respectively, within each tubular body 232, 234, which also extends longitudinally along a longitudinal length of the receiver extension 58.

Each tubular body 232, 234 of each front and rear guide rod support 222, 224 is located laterally along a longitudinal side of the buffer tube (tubular) body 62 of the buffer tube 60, with each of the tubular bodies 62, 232, 234 formed together as a one-piece (monolithic) structure. More particularly, each tubular body 232, 234 of each front and rear guide rod support 222, 224 is located below a midline of the stock assembly 50 such that each guide rod 200 located therein is located laterally along the lower receiver 12 when the stock assembly 50 is collapsed.

Each tubular passage 242, 244 as a longitudinal axis LA which is parallel with the longitudinal axis LA of the buffer 54/recoil spring 56/receiver extension 58*a*, and more particularly the buffer tube 60. The longitudinal axis LA of each tubular passage 242, 244 of each tubular body 232, 234 is also parallel and concentric/coaxial (i.e. sharing the same longitudinal axis LA) with the longitudinal axis LA of the guide rod 200 located therein.

As shown in FIG. 2, each front and rear guide rod support 222, 224 is longitudinally spaced apart such that a gap or recess 250 is provided therebetween. Recess 250 is configured to receive a guide rod latch 260, which is disposed intermediate between each of front guide rod support 222 and rear guide rod support 224.

More particularly, recess 250 is configured to receive movable guide rod latch body 262 of guide rod latch 260, which is configured to move with linear motion transverse to the longitudinal axis of the buffer 54/recoil spring 56/receiver extension 58. As shown, guide rod latch body 262 is disposed intermediate between each of front guide rod support tubular body 232 and rear guide rod support tubular body 234.

As shown by FIG. 2 and FIGS. 12-14, guide rod latch body 262 includes two laterally spaced outer tubular portions 266 each including a tubular passage 268. Outer tubular portions 266 flank a central portion 270, which on an inner face 272 provides a semi-circular recess to receive the buffer tube (tubular) body 62 of the buffer tube 60 and on an outer face 274 provides a serrated finger pad for actuation.

Figure 14:
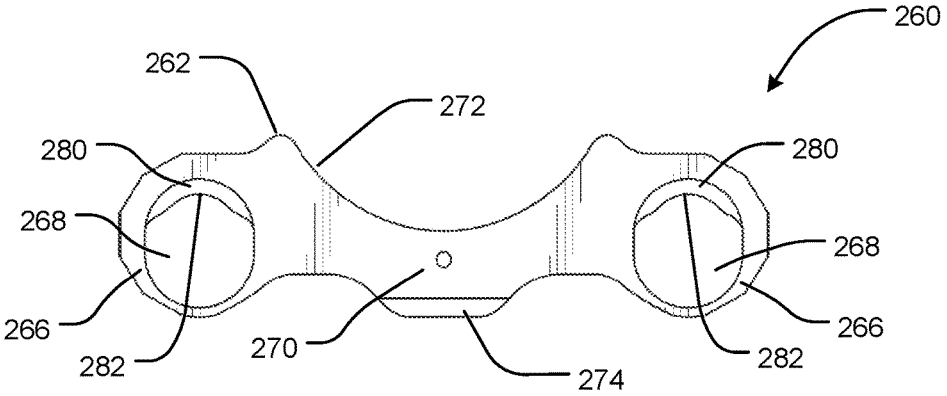
FIG. 14 is a front view of the stock adjustment lock of the collapsible/extendable stock assembly of the firearm of FIGS. 1A-1D.

As best shown by FIG. 14, each of the tubular passages 268 includes a protrusion 280 which defines a portion of the tubular passage 268. As shown, protrusion 280 is in the form of an arcuate rib (which is shown to be semi-circular around the longitudinal axis LA) with an arcuate leading edge and/or leading surface 282 (which is also shown to be semi-circular around the longitudinal axis LA). As shown, the rib extends transverse to a longitudinal axis of the tubular passage 268. During use of the stock assembly 50, protrusion 280 of the guide rod latch body 262 is configured to fit into and mate individually with each recess 210 of the guide rod, depending on the desired length of the stock 160.

When assembled, each guide rod 200 extends through the front guide rod support tubular passage 242, guide rod latch body tubular passage 268 and rear guide rod support tubular passage 244, front to rear, along the longitudinal axis LA. When the stock assembly 50 reaches maximum extension, guide rod front end stops 150 inhibit further extension by engaging (forming a positive mechanical interference) with front guide rod support tubular body 232, particularly as the guide rod front end stops 150 have a larger diameter than the outer diameter of the guide rods 200.

In order to bias inward movement of the guide rod latch body 262, the guide rod latch 260 may include a biasing member 290, which may particularly be in the form of a helical compression spring. Biasing member 290 may be inserted into biasing member receptacle 282, which may be particularly in the form of a blind bore formed in the central portion 270 of the guide rod latch body 262. The biasing member 290 is slidable within the biasing member receptacle 292 and, in an uncompressed state, the has a length greater than the length of the biasing member receptacle 292. The opening to the blind bore of the biasing member receptacle 292 of the guide rod latch body 262 may be located on the inner face 272 of central portion 270. With such an arrangement, the biasing member 290 may contact against the buffer tube 60 of the receiver extension 58 during use thereof, to bias inward movement of the guide rod latch body 262.

In order to change the length of the stock 160, either by extending or collapsing, the guide rod latch body 262 may be depressed inwards from a home (rest), engaged position to a released or disengaged position, at which time the protrusion 180 of the guide rod latch body 262 will exit/disengage from a guide rod recess 210. The length of the stock 160 may then be freely adjusted. When the length of the stock 160 is of the approximate desired length, the guide rod latch body 262 may be released, and pushed in an outward direction by the bias of the biasing member 290 back towards the engaged position. If the protrusions 280 of the guide rod latch body 262 do not immediately reengage with a different guide rod recess 210, the stock 160 may be slightly shortened or lengthened (during which time the protrusions 280 will slide along the outer diameter of the guide rod 200) until the protrusions longitudinally align with the new guide rod recess 210, at which time the biasing member 290 will force the protrusions 280 outwards to enter into the new recess 210 and the guide rod latch body 262 will return to its home, rest), engaged position.

Again, to assemble the stock assembly 50, each guide rod 200 is inserted through the front guide rod support tubular passage 242, guide rod latch body tubular passage 268 and rear guide rod support tubular passage 244, front to rear, along the longitudinal axis LA, with the biasing member 290 positioned between the left and right guide rods 210 and guide rod supports 216.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application. This specification is not intended to be exhaustive or to limit the invention to the precise form disclosed. Many modifications and variations are possible in light of this disclosure.

LIST OF REFERENCE CHARACTERS

2 firearm
10 receiver
12 lower receiver
14 upper receiver
16 bolt carrier group
18 bolt carrier
19 bolt carrier tubular passage (bore)
20 rear end of bolt carrier
30 barrel
36 handguard
40 pistol grip
42 magazine
44 magazine receptacle
50 adjustable length stock assembly
54 buffer
56 recoil spring

58 receiver extension
60 buffer tube
62 buffer tube (tubular) body
63 longitudinal wall of (tubular) body
64 tubular passage
65 inner face of the tubular passage
66 tubular passage opening
68 rear end wall
70 tubular body front end portion
72 receiver extension (castle) nut
74 receiver end plate
80 front section of buffer
82 intermediate section of buffer
83 shoulder
84 rear section of buffer
86 front face of intermediate section
88 rear face of intermediate section
90 annular recess of front face
92 annular outer perimeter lip
98 buffer catch
100 movable buffer catch body
102 buffer catch body outer section
104 buffer catch body inner section
106 buffer catch outer section shoulder
108 biasing member receptacle
110 retaining member receptacle
112 front face of inner section
114 rear face of inner section
116 lateral faces
118 protrusion
120 buffer catch body receptacle
122 buffer catch receptacle outer section
124 buffer catch receptacle inner section
126 buffer catch receptacle outer section bottom wall
128 retaining member travel receptacle
120 travel receptacle stop
130 biasing member
140 retaining member
150 front end stop
160 stock
162 stock mounting boss for guide rod
164 buffer tube aperture
166 sling mount aperture
170 sling mount
200 guide rod
202 front end portion of guide rod
204 internally threaded bore
206 rear end portion of guide rod
208 external threads
210 guide rod recesses
212 recess bottom
216 guide rod support
218 guide rod support tubular body
220 guide rod support tubular passage
222 front guide rod support
224 rear guide rod support
232 front guide rod support tubular body
234 rear guide rod support tubular body
242 front guide rod support tubular passage
244 rear guide rod support tubular passage.
250 recess
260 guide rod latch
262 guide rod latch body
266 guide rod latch body tubular portions
268 guide rod latch body tubular passage
270 central portion
272 inner face of central portion
274 outer face of central portion
280 protrusion
282 protrusion leading edge/surface
290 biasing member
292 biasing member receptacle

What is claimed is:

1. A stock assembly for a firearm, the stock assembly comprising:
a buffer catch comprising a movable buffer catch body;
a receiver extension comprising a buffer tube;
the buffer tube comprising a buffer tube body and a tubular passage within the buffer tube body;
the buffer tube body comprising a buffer catch receptacle extending through a wall of the buffer tube body extending along a longitudinal axis of the buffer tube;
the buffer catch receptacle configured to receive the buffer catch body therein;
the buffer catch body configured to move within the buffer catch receptacle from a home position to a depressed position;
in the depressed position, the buffer catch body blocks at least a portion of the tubular passage of the buffer tube;
a buffer configured to move within the tubular passage of the buffer tube;
the buffer comprising a front section, an intermediate section and a rear section; and
the intermediate section of the buffer providing an annular shoulder having a front face and a rear face.

2. The stock assembly of claim 1, wherein:
the front section of the buffer is configured to reside within a bolt carrier of the firearm.

3. The stock assembly of claim 1, wherein:
the front section of the buffer has a front section diameter;
the intermediate section of the buffer has an intermediate section diameter;
the rear section of the buffer has a rear section diameter;
the intermediate section diameter is larger than the rear section diameter; and
the rear section diameter is larger than the front section diameter.

4. The stock assembly of claim 1, wherein:
the front face of the annular shoulder of the buffer has an annular recess;
the buffer catch body has a rear face configured to engage with the front face of the annular shoulder of the buffer;
the rear face of the buffer catch body has a protrusion; and
in the depressed position, the annular recess of the buffer is configured to receive the protrusion of the buffer catch body.

5. The stock assembly of claim 1, wherein:
the buffer catch body is configured to move inward within the buffer catch receptacle from the home position to the depressed position, and vice-versa.

6. The stock assembly of claim 1, further comprising:
a biasing member configured to bias depressing the buffer catch body from the home position to the depressed position.

7. The stock assembly of claim 1, further comprising:
a retaining member configured to retain the buffer catch body in the buffer catch receptacle.

8. The stock assembly of claim 1, wherein:
the stock assembly is configured to be installed on an M/16 AR-15 pattern firearm.

9. A stock assembly for a firearm, the stock assembly comprising:
a buffer catch comprising a movable buffer catch body;
a receiver extension comprising a buffer tube;

the buffer tube comprising a buffer tube body and a tubular passage within the buffer tube body;

the buffer tube body comprising a buffer catch receptacle extending through a wall of the buffer tube body extending along a longitudinal axis of the buffer tube;

the buffer catch receptacle configured to receive the buffer catch body therein;

the buffer catch body configured to move within the buffer catch receptacle from a home position to a depressed position;

in the depressed position, the buffer catch body blocks at least a portion of the tubular passage of the buffer tube;

a buffer configured to move within the tubular passage of the buffer tube;

the buffer comprises a front section, an intermediate section and a rear section;

the front section of the buffer having a front section diameter;

the intermediate section of the buffer having an intermediate section diameter;

the rear section of the buffer having a rear section diameter;

the intermediate section diameter larger than the rear section diameter; and the rear section diameter larger than the front section diameter.

10. The stock assembly of claim 9, wherein:

the front section of the buffer is configured to reside within a bolt carrier of the firearm.

11. The stock assembly of claim 9, wherein:

the intermediate section of the buffer provides an annular shoulder having a front face and a rear face.

12. The stock assembly of claim 11, wherein:

the front face of the annular shoulder of the buffer has an annular recess;

the buffer catch body has a rear face configured to engage with the front face of the annular shoulder of the buffer;

the rear face of the buffer catch body has a protrusion; and in the depressed position, the annular recess of the buffer is configured to receive the protrusion of the buffer catch body.

13. The stock assembly of claim 9, wherein:

the buffer catch body is configured to move inward within the buffer catch receptacle from the home position to the depressed position, and vice-versa.

14. The stock assembly of claim 9, further comprising:

a biasing member configured to bias depressing the buffer catch body from the home position to the depressed position.

15. The stock assembly of claim 9, further comprising:

a retaining member configured to retain the buffer catch body in the buffer catch receptacle.

16. The stock assembly of claim 9, wherein:

the stock assembly is configured to be installed on an M/16 AR-15 pattern firearm.

* * * * *